US007171300B1

(12) United States Patent
Anderson

(10) Patent No.: US 7,171,300 B1
(45) Date of Patent: Jan. 30, 2007

(54) INTELLIGENT SLEEP MODE FOR MACHINES WITH INTERNAL COMBUSTION ENGINES

(75) Inventor: Noel Wayne Anderson, Fargo, ND (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 11/222,327

(22) Filed: Sep. 8, 2005

(51) Int. Cl.
*F02D 45/00* (2006.01)

(52) U.S. Cl. ..... 701/112; 701/2; 701/115

(58) Field of Classification Search ..... None
See application file for complete search history.

(56) References Cited

U.S. PATENT DOCUMENTS 5,999,876 A 12/1999 Irons et al. ..... 701/115
6,751,543 B2 6/2004 Gras et al. ..... 701/103
6,778,894 B2 8/2004 Beck et al. ..... 701/50
6,779,344 B2 8/2004 Hartman et al. ..... 60/600

OTHER PUBLICATIONS

Tennies, N. Embedded Systems Programming, [online], Jan. 2003, [retrieved on Jun. 23, 2005] Retrieved from the Internet: <URL: http://www.embedded.com/story/OEG20030121S0057>.
Maillard, H. PSA Peugeot Citroen Press Kit: Stop & Start, Sep. 2004.

*Primary Examiner*—Andrew M. Dolinar

(57) ABSTRACT

The present invention provides one or more methods of placing a machine with an internal combustion engine in an intelligent sleep mode. The system minimizes fuel costs and reduces wear for a machine using an internal combustion engine by monitoring various engine parameters to determine if during waiting or idle periods, it would be best to place the engine in a sleep mode. The system continues to monitor the machine while it is in sleep mode to determine if it is most advantageous, taking into consideration one or more factors, such as engine wear, fuel costs, duration of idle time, and the like, for the engine to remain in the current sleep mode, be shut down, be restarted, or in some instances, be placed in a different level of intelligent sleep mode.

24 Claims, 4 Drawing Sheets

INTELLIGENT SLEEP MODE FOR MACHINES WITH INTERNAL COMBUSTION ENGINES

FIELD OF THE INVENTION

The present invention relates to methods and apparatus for the control of internal combustion engines. More specifically, the present invention is directed to an intelligent sleep mode for internal combustion engines.

BACKGROUND OF THE INVENTION

In many vehicles, when the vehicle is not being used, or is idling or in "wait" mode, operators tend to turn off the vehicle in order to conserve fuel, prevent pollution, reduce vehicle engine or auxiliary system wear, or some combination of the above. This is particularly common in commercial vehicles, where usage situations often result in vehicles idling while waiting for action on the part of other commercial vehicles, operators, or other external factors. Such conservation measures are becoming more prevalent with the rising costs of fuel, and the increasing use of sophisticated systems that require maintenance after a specific number of operating hours.

However, with internal combustion engines, including diesel engines, turning off the machine while it is not actually in use, and then restarting the machine, typically from a cold or cool state, although it may save fuel, can increase certain types of engine and system wear, as opposed to if the engine is left to idle, or restarted from a "warm" state.

SUMMARY OF THE INVENTION

The present invention, accordingly, provides one or more methods of placing the engine in an intelligent sleep mode when it is not being used, that will monitor the engine state while it is sleeping, and determine if engine efficiency would be maximized by keeping the engine in the sleep mode state, or whether the engine should be restarted, or even completely shut down. In some arrangements, the engine can even have more than one level of sleep mode state. This intelligent sleep mode, with continuing monitoring and assessment to determine the most advantageous state for the engine improves engine utilization, increases efficiency, and minimizes engine wear that would occur with an increased number of cold engine starts.

For example, one form of intelligent sleep mode would turn off the engine pistons, but would continue to power one or more sensors or other mechanisms to provide information about the engine to the engine control unit. This information would enable the engine control unit to determine if the engine should be restarted and run for an appropriate interval to keep the engine from getting cold, thus reducing wear to the engine and various component systems that would occur with increased cold starts. This invention could also be used to prevent the battery from becoming discharged. Alternatively, another form of intelligent sleep mode could leave the engine running in a reduced idle state, but turn off one or more peripheral or auxiliary systems, such as hydraulic pumps. It can be appreciated that an intelligent sleep mode could also take various other forms, depending on the specific vehicle and engine arrangement, and that more than one type of sleep mode could be utilized with a specific vehicle.

In one embodiment of the present invention, the vehicle operator is provided with a method of selecting to place the vehicle engine into intelligent sleep mode. When the engine is in intelligent sleep mode, various components, such as sensors will continue to monitor information such as engine temperature, duration of idle time, battery discharge state, or other relevant factors about the engine and peripheral engine components, and provide the information to an engine control unit and it's intelligent sleep mode system. Based on the information received, the intelligent sleep mode system will determine if the engine should be allowed to continue in the same level of sleep mode, or if the equipment state should be altered in some way. For example, based on engine temperature or battery charge state, the system may determine that the engine should be restarted and run until a specific engine temperature or battery charge state has been achieved, at which time the engine can be placed back in intelligent sleep mode if it is still not being used.

In another embodiment of the present invention, the engine control unit may determine that it may be most advantageous for the machine to place it in some type of sleep mode, based on the current activity level of the machine. The engine control unit seeks input from the operator as to the estimated amount of time the vehicle will be idle, or examines previous similar situations to determine the likely period of inactivity. The engine control unit uses the information to calculate and compare costs based on projected idle time, fuel costs, wear and maintenance costs, and even the number of starts and stops already incurred on the particular engine, and decides whether it would be most advantageous to place the engine into some level of intelligent sleep mode, or allow it to continue to run. Once the engine has been placed in sleep mode, based on the information received, the intelligent sleep mode system will determine if the engine should be allowed to continue in the same level of sleep mode, or if the equipment state should be altered in some way.

In yet another embodiment of the present invention, when a machine is operating in conjunction with one or more other machines, a determination of whether or not to place an engine in intelligent sleep mode could be made based on the activities and inter-relationship of those machines (i.e. dump trucks working with an excavator/loader). Based on information received from the vehicle operator, prior history for the machine in similar situations, and/or information obtained from the other machines in the working group, the engine control unit can put the engine on a specific machine in an intelligent sleep mode until that machine is needed again. While the machine is in intelligent sleep mode, the engine control unit will continue to monitor various parameters, such as engine temperature, duration of idle time, battery discharge state and/or other relevant factors, and determine if the engine should be allowed to continue in the same level of sleep mode, or if the engine state should be altered in some way.

It can be appreciated that various arrangements of the present invention would be useful in different environments or with different equipment. The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
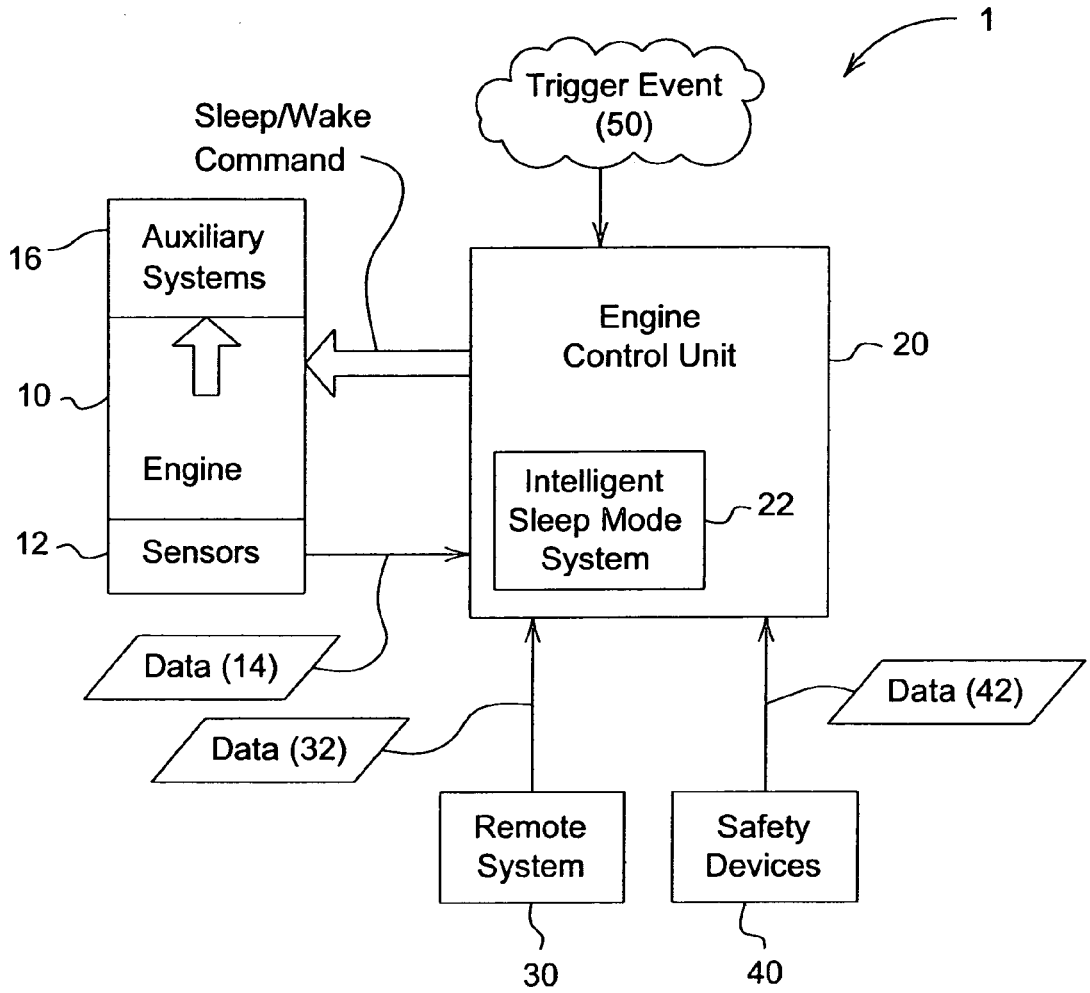
FIG. 1 is a schematic block diagram representation of a system of the present invention, including optional and external devices used to communicate with the system of the present invention.

In the discussion of the FIGURES the same reference numerals will be used throughout to refer to the same or similar components. In the interest of conciseness, various other components known to the art, such as throttles, fuel system components, and the like necessary for the operation of the equipment and the internal combustion engines, have not been shown or discussed.

In the following, numerous specific details are set forth to provide a thorough understanding of the present invention. However, it will be obvious to those skilled in the art that the present invention may be practiced without such specific details. In other instances, well-known elements have been illustrated in schematic or block diagram form in order not to obscure the present invention in unnecessary detail. Additionally, for the most part, details concerning engine operation and the like have been omitted inasmuch as such details are not considered necessary to obtain a complete understanding of the present invention, and are considered to be within the knowledge of persons of ordinary skill in the relevant art.

Refer now to the drawings wherein depicted elements are, for the sake of clarity, not necessarily shown to scale and wherein like or similar elements are designated by the same reference numeral through the several views.

The present invention provides a method of placing a vehicle having an internal combustion engine into an intelligent sleep mode that will help reduce engine wear and fuel consumption, while taking steps to ensure the engine does not suffer from additional wear due to more frequent cold starts of the engine, as would occur if the engine were simply shut down and restarted when needed, or incur other types of wear, such as battery discharge or wear to hydraulic systems. The system utilizes an engine control unit that incorporates the necessary hardware and utilizes the necessary software to enable placing the engine into an intelligent sleep mode. The engine control unit will also continue to monitor the engine when it is in the intelligent sleep mode. It can be appreciated that depending upon the specific vehicle configuration and engine type, the sleep mode or modes for a particular vehicle would vary.

As shown in FIG. 1, the system 1 of the present invention is for a device containing an internal combustion engine 10 controlled by an engine control unit 20 that incorporates an intelligent sleep mode system 22. The engine 10 has associated with it one or more sensors 12 capable of monitoring various engine functions, such as equipment temperature, fluid pressure, fluid temperature, battery charge status, number of engine starts, engine wear, and the like. The engine 10 can also incorporate one or more auxiliary systems 16, such as hydraulic pumps and the like. Data 14 about the engine 10 collected by the sensors 12 is provided to the engine control unit 20. The data 14 can be provided to the engine control unit 20 continuously, or at intervals. It should be appreciated that the interval at which the data 14 is provided to the engine control unit 20 from the sensors 12, as well as which sensors 12 are used to provide information to the engine control unit 20 can be adjusted as appropriate to a specific situation or need. In some arrangements of the present invention, the engine control unit 20 and the intelligent sleep mode system 22 are also capable of receiving data 32 from one or more remote systems 30, such as a remote maintenance system that provides information about such things as engine wear, prior service/repairs, scheduled maintenance and the like.

When a trigger event 50, such as shifting the transmission to a specific position, turning a key, pressing a button on the machine or a remote starting device to a "sleep" position, a request by a vehicle operator as to whether the vehicle should be placed in intelligent sleep mode, or an extended period of engine idling occurs, the intelligent sleep mode system 22 will analyze the trigger event 50 and data 14, 32 collected, and send a command to the engine control unit 20 to put the engine 10 into intelligent sleep mode. Typically, when the engine 10 is in intelligent sleep mode, even if the engine pistons cease to operate or are throttled down, or certain auxiliary systems are turned off, various other components, such as sensors 12 and the engine control unit 20 will remain in an on or reduced on state for, among other purposes, to continue monitoring the engine 10. The information collected by the sensors 12 while the engine 10 is in intelligent sleep mode is made available to the intelligent sleep mode system 22 which will use the data to determine if the engine 10 should remain in intelligent sleep mode, be turned back on, turned off, or in some instances, be placed in a different intelligent sleep mode. For example, in some arrangements of the present invention, even if it is not feasible to completely shut down the engine 10, it may be possible to increase engine efficiency by throttling down the engine speed and/or shutting off one or more auxiliary systems 16, thus decreasing fuel use while reducing equipment wear. This could constitute a different level of intelligent sleep mode, wherein the engine is not shut down, but is idled back, and auxiliary system(s) 16 can be shut down completely. It can be appreciated that the specific sleep mode(s), data to be monitored and thresholds will vary depending upon the specific engine and components used on a particular machine.

Additionally, in some arrangements of the present invention, the engine control unit 20 and its intelligent sleep mode system 22 are capable of intelligent machine learning, and can access historical events for a particular machine to more accurately determine the likelihood that the machine should be placed in sleep mode, based at least in part on prior activities for the particular machine. For example, if the machine operator takes a 2-hour break every day at approximately the same time, the system could, over time, identify the pattern, and know that when the machine becomes idle around that specific time period, it would be most beneficial to the machine to place the engine 10 in sleep mode until the machine operator returns. During the time the engine 10 is in sleep mode, the engine control unit 20 and its intelligent sleep mode system 22 will continue to monitor data 14 from the sensors 12, and calculate whether the engine should remain in sleep mode, be turned off, or be restarted and run for a certain period of time. In this example, based on the information about the machine and previous activity, the engine control unit 20 may also learn that the engine 10 should be restarted if the engine temperature falls below a certain level during the sleep mode period. It can be appreciated that the level and sophistication of machine learning that occurs, when available, will vary based on the engine 10, data 14, 32 available to the engine control unit 20, and other system elements.

Additionally, the present invention can include various safety devices 40 that work in conjunction with the engine control unit 20. For example, an engine 10 in intelligent sleep mode could present the appearance of an engine 10 that has been shut off. A person believing the engine was shut off could attempt to work on the engine, and possibly be injured if the engine were to restart unexpectedly. To prevent possible injuries, the system could be configured to change from sleep mode to complete shut down mode if the engine compartment is opened up while the engine 10 is in sleep mode. Alternatively, the system could require that the engine be placed in a full "off" mode before the engine compartment could be opened. Such protection mechanisms would help to ensure no engine control unit initiated starts of the engine 10 from sleep mode cause harm to any persons or property. A variety of other safety devices 40 could also be used, such as motion or proximity detectors. The actual safety devices 40 used will depend upon the particular equipment and arrangement thereof.

Figure 2:
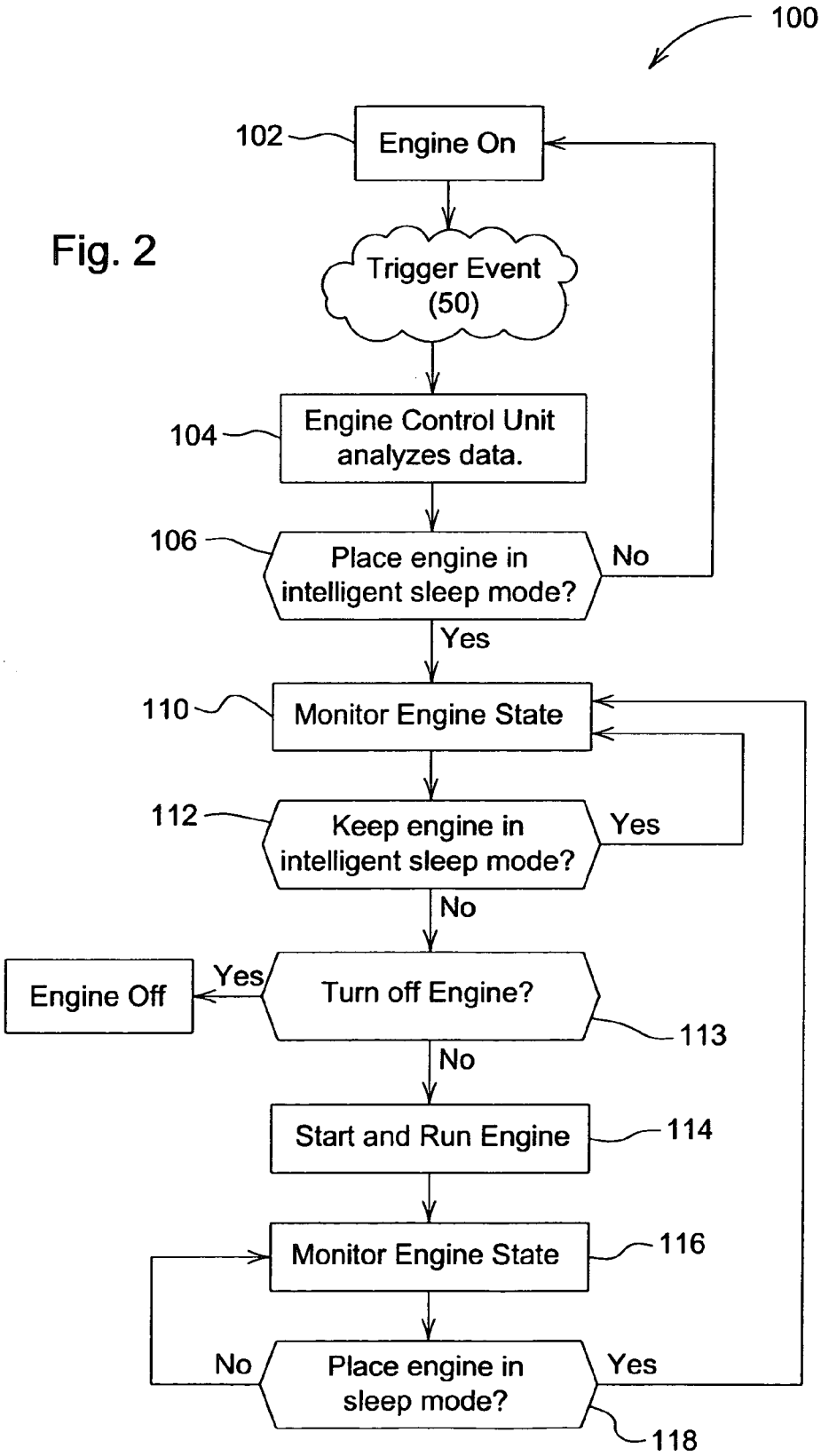
FIG. 2 is a flow diagram showing one embodiment of a method of the present invention.

In one arrangement 100 of the method of the present invention, as shown in FIG. 2, the vehicle operator is provided with a method of putting the vehicle engine 10 into sleep mode. Initially, in the first step 102, the engine is running. In the second step 104, if a trigger event 50 occurs, the intelligent sleep mode system 22 of the engine control unit 20 will perform one or more algorithms to analyze the data 14, 32 it collects from sensors 12 and remote systems 30 and calculate costs based on fuel costs, wear and maintenance costs, and even the number of starts and stops already incurred on the particular engine and the state of that particular engine and determine whether to have the engine control unit 20 place the engine 10 in intelligent sleep mode in step 106. In some arrangements of the present invention, for certain trigger events 50, the engine control unit 20 could place the engine in intelligent sleep mode as at step 106 without having to perform the analysis of step 104.

Once the engine 10 is in a sleep state, the intelligent sleep mode system 22 of the engine control unit 20 will, at intervals, execute a monitoring algorithm 110 that will analyze data from the sensor(s) 12 about various engine information, such as engine temperature, fluid temperatures, battery charge status and the like. Based on the information received, and the calculations performed by the monitoring algorithm in step 110, the intelligent sleep mode system 22 will, at step 112, determine if the engine 10 should remain in the intelligent sleep mode, or in some configurations of the present invention, alternatively, to place the engine 10 in a different intelligent sleep mode, such as one that leaves the engine running, but shuts down auxiliary systems 16.

If the engine remains in an intelligent sleep mode, at step 112, the monitoring algorithm 110 will be executed at the next predefined interval. If the outcome of the monitoring algorithm at step 110 is that the engine should not remain in intelligent sleep mode at step 112, then at step 113, the engine control unit 20 will determine if the engine should be shut off completely, or restarted. If the engine is to be restarted, then at step 114 a command will be sent from the intelligent sleep mode system 22 to the engine control unit 20 to start the engine 10 and run it for a specified period of time. In some configurations of the present invention, at step 114 the engine control unit 20 will automatically start the engine, or in other, semi-automated configurations, the operator will be notified that the engine 10 should be started.

Once the engine 10 has been started at step 114, an additional algorithm is executed at step 116 that monitors the running engine 10 until the optimum parameter(s) calculated by the algorithm at step 116 for that engine 10 have been achieved, at which time, in step 118, the system will place the engine 10 back in an intelligent sleep mode, or in some systems, send a command to the operator to place the engine back in an intelligent sleep mode, and return to monitoring the engine state as in step 110.

In some arrangements of the present invention, the monitoring algorithms 104, 110, 116 can also receive information 32 from remote systems 30 about such things as engine repair history, wear data, scheduled maintenance, etc.

When the operator restarts the engine, intelligent sleep mode will be exited, and not be resumed until another trigger event 50 occurs.

An example utilizing the arrangement of the present invention shown in FIG. 2 is provided herein for greater clarity. In this example, assume the vehicle engine 10 is placed in intelligent sleep mode at step 106, and the sensors 12 are providing the intelligent sleep mode system 22 data 14 about the engine temperature and battery charge status in step 110. Upon receiving the data 14 from the sensors 12, one or more algorithms would be performed at step 112 to determine if the engine 10 should be allowed to continue cooling for an additional interval (i.e. until the next sensor reading). The algorithm(s) would calculate whether the incremental cost of starting the engine 10 if it was allowed to cool for an additional time period would be greater than the cost of starting and running the engine at the present time 10, and would also calculate whether the battery discharge state would drop below an acceptable charge level if the engine was not restarted before the next sensor reading. The costs of starting and running the engine 10 would include calculations related to battery charge state, fuel costs, and the costs of allowing the engine to cool for an additional period would include such costs as increased wear and engine failure resulting from a colder start, and the increased maintenance costs incurred due to the increase in cold starts.

The outcome of the algorithm(s) performed at step 112 would determine whether the engine should remain off. If so, the system would return to step 110 and resume monitoring. If not, then at step 114, the electronic control unit 20 would start the engine 10, or provide a signal to the operator to start the engine 10. The electronic control unit/intelligent sleep mode system 20/22 would monitor the running engine at step 116 until the sensor 12 indicates that a specific temperature and/or battery charge state calculated back at step 112 was met, at which time the intelligent sleep mode system 22 would signal the electronic control unit 20 to put the engine 10 back in sleep mode, and resume monitoring the sensor data as at step 110.

Figure 3:
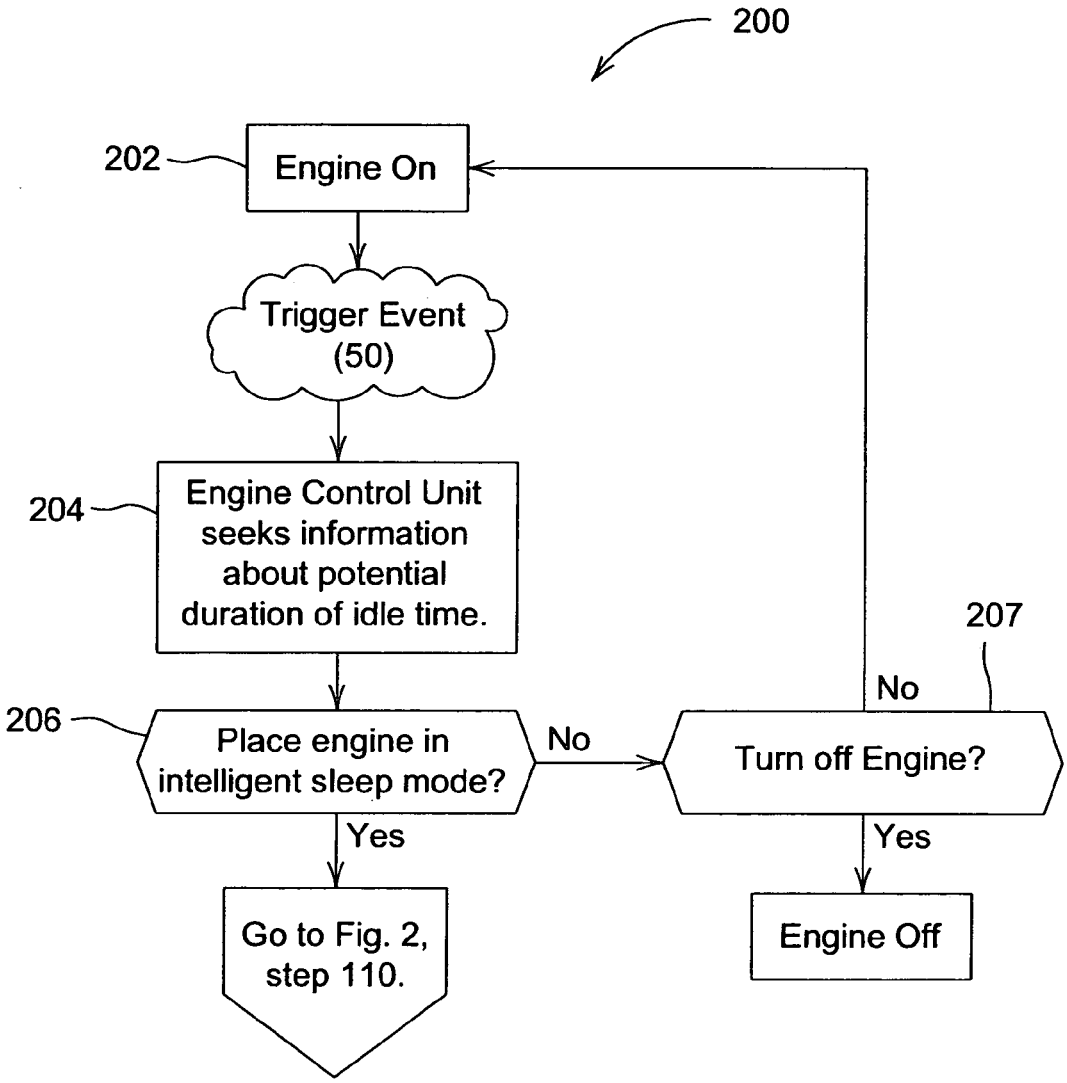
FIG. 3 is a flow diagram showing another embodiment of a method of the present invention.

Another arrangement 200 of the present invention is shown in FIG. 3. Initially, in step 202, the engine is in the "on" state. In the second step 204, if a trigger event 50 occurs, the engine control unit 20 will seek information about the potential duration of the idle state for the engine.

The engine control unit 20 could prompt the operator for that information, or alternatively, or if such information is not known, or if the operator does not or can not provide the information, historical data for the machine could be evaluated to determine past activities. In step 206, one or more algorithms will be performed using the information obtained to determine whether to have the engine control unit 20 place the engine 10 in intelligent sleep mode. If so, the intelligent sleep mode system 22 will tell the engine control unit 20 to place the engine 10 in a sleep state. In some arrangements of the present invention, the engine control unit 20 would prompt the vehicle operator to place the engine 10 in sleep mode. If the engine is placed in intelligent sleep mode, then the engine state will be continue to be monitored while the engine 10 is in sleep mode, as in steps 110 and subsequent in FIG. 2. If, based on the outcome of the calculations performed in step 206 the engine 10 is not placed in intelligent sleep mode, then in step 207, at least one additional algorithm is performed to determine if the engine should be turned off completely, or allowed to continue to run. It can be appreciated that various configurations of this arrangement of the present invention would be useful in different environments, with different equipment, or with different operators.

In some arrangements of the present invention, the monitoring algorithms 206, 207 can also receive information 32 from remote systems 30 about such things as engine repair history, wear data, scheduled maintenance, etc.

Figure 4:
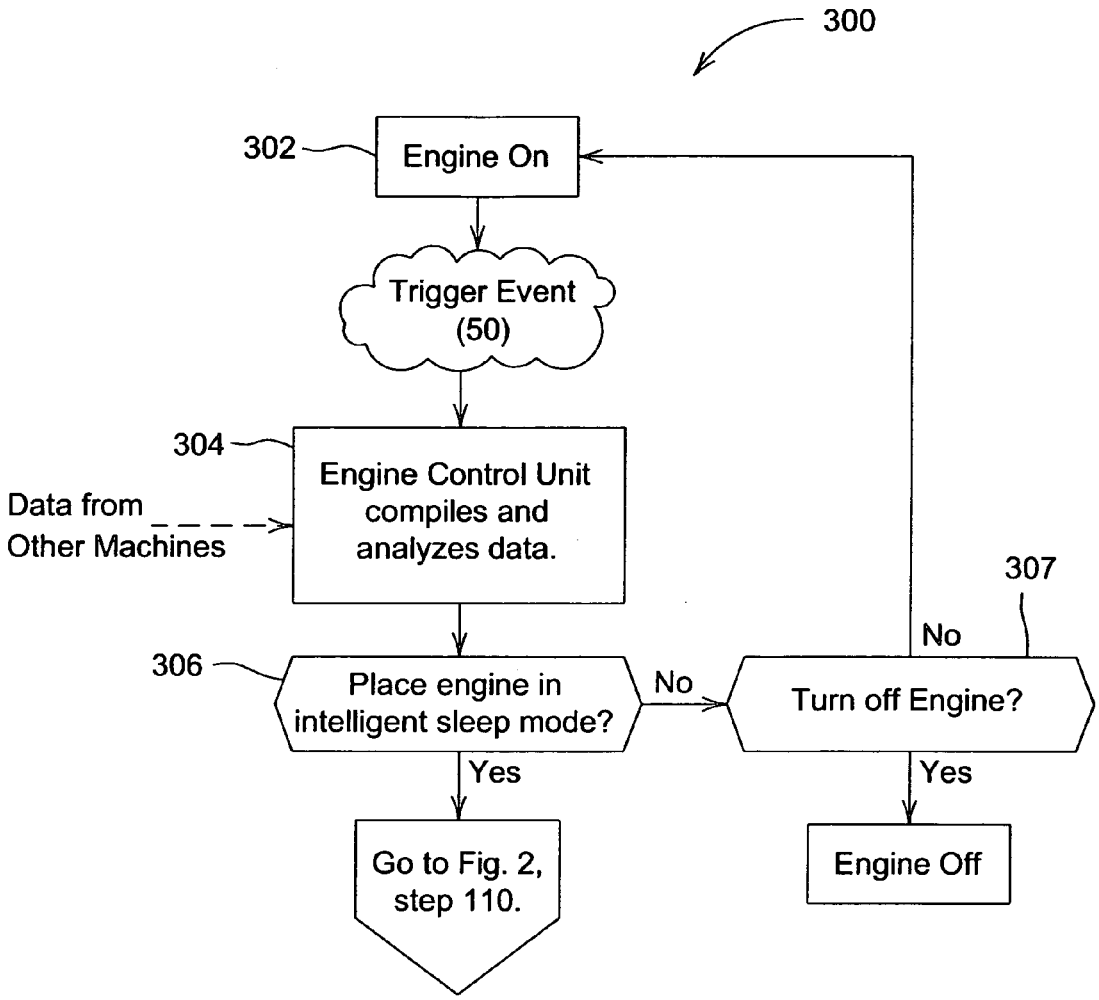
FIG. 4 is a flow diagram showing yet another embodiment of a method of the present invention.

In yet another arrangement 300 of the present invention, as shown in FIG. 4, a machine is operating in conjunction with one or more other machines. This is typically seen in instances where hauling vehicles are used in conjunction with vehicles responsible for digging, harvesting or otherwise acquiring material, although other applications could also benefit from use of this arrangement 300 of the present invention. In step 302, the engine 10 of a particular machine is on. A trigger event 50 might occur, such as the engine 10 sitting idle for a period of time. At step 304, the intelligent sleep mode system 22 will perform one or more algorithms to calculate whether or not to turn off the engine 10 or put it into "sleep" mode, based on information it may receive from the operator, or data from the other machines working at the site, a worksite fleet management mechanism or person, or information the system 22 and engine control unit 20 have already learned from previous activities at the same site. At step 306, based on the calculations performed in step 304, the intelligent sleep mode system 22 will tell the engine control unit 20 whether to place the engine 10 in intelligent sleep mode. In some arrangements of the present invention, the engine control unit 20 would provide data to the vehicle operator, prompting the user to place the engine 10 in sleep mode. If the engine is placed in intelligent sleep mode, then the engine state will continue to be monitored while the engine 10 is in sleep mode, as in steps 110 and subsequent in FIG. 2. If, based on the outcome of the calculations performed the engine 10 is not placed in intelligent sleep mode, then in step 307, at least one additional algorithm is performed to determine if the engine 10 should be turned off completely, such as if there will be a long wait or the battery charge is low, or allowed to continue to run. It can be appreciated that various configurations of this arrangement would be useful in different environments, with different equipment, or with different operators.

In some arrangements of the present invention, the monitoring algorithms 306, 307 can also receive information 32 from remote systems 30 about such things as engine repair history, wear data, scheduled maintenance, etc.

One example in which this arrangement 300 of the present invention might be used would be if an excavator was working with one or more dump trucks. If a dump truck operator has dumped a load, and there are several empty dump trucks in front of him waiting to be filled, he might wish to put the engine of the dump truck in intelligent sleep mode or turn the engine off. Based on information about the number of other dump trucks waiting in line, the speed at which the excavator is working, and other related factors which might be obtained from the operator, from the other machines working at the site, or already learned and stored based upon previous activities at the same site, the algorithm(s) performed will determine if it is most advantageous for the dump truck engine to be placed in sleep mode, be shut down completely, or allowed to continue to run in idle state. In this situation, it can be appreciated that more than one level of sleep mode might be appropriate. For example, even if shutting down the engine pistons may not be beneficial based on the projected idle time, it may still be beneficial to shut down the hydraulic system of the dump unit.

Another example of a situation in which this arrangement of the present invention may be useful would be if a combine was working with one or more grain carts, and the combine has to halt operations when the grain cart becomes full. Based on calculations such as where in the field the machines are located, how far the grain cart has to go to dump its load, and how long it takes the grain cart to unload, or whether there is more than one grain cart working with the combine, it could be determined if it is more efficient to put the combine into sleep mode while the grain cart is off emptying its load, or whether it is more practical to keep the combine engine running. For example, if a combine is operating with two grain carts, it may be only a very short period of time between when one grain cart is full and needs to go empty its load and when the second grain cart will return from emptying its load. In that case, it would be more efficient to leave the combine running until the second grain cart has returned and is in position to accept harvested product. If on the other hand, the combine was running with only a single grain cart, and there would be an extended period of time before the grain cart could return from emptying its load, it might be determined to put the engine in sleep mode while the combine is sitting idle.

It is understood that the present invention can take many forms and embodiments. Accordingly, several variations may be made in the foregoing without departing from the spirit or the scope of the invention. Having described the preferred embodiment, it will become apparent that various modifications can be made without departing from the scope of the invention as defined in the accompanying claims.

I claim:

1. An apparatus for monitoring and controlling engine operation to enhance engine efficiency comprising:

(a) an internal combustion engine;

(b) at least one sensor for monitoring one or more engine parameters; and (c) an engine control unit configured to:

(i) receive information from the at least one sensor about the engine parameters, (ii) perform at least a first computerized algorithm to determine whether, based at least in part on the information received from the at least one sensor, the engine should be placed in sleep mode, (iii) continue to receive information from the at least one sensor about engine parameters after placing the engine in sleep mode, (iv) perform at least a second computerized algorithm to determine whether, based at least in part on the information received from the at least one sensor, the engine should remain in sleep mode.

2. The apparatus of claim 1 wherein the engine control unit is further configured to receive information from at least one remote system.

3. The apparatus of claim 2 wherein the engine control unit uses the information received from the at least one remote system in at least the first computerized algorithm.

4. The apparatus of claim 2 wherein the engine control unit uses the information received from the at least one remote system in at least the second computerized algorithm to determine whether the engine should remain in sleep mode.

5. The apparatus of claim 1 wherein the engine control unit is further configured to receive information from at least one external source.

6. The apparatus of claim 5 wherein the engine control unit uses the information received from the at least one external source in at least the first computerized algorithm.

7. The apparatus of claim 5 wherein the engine control unit uses the information received from the at least one external source in at least the second computerized algorithm to determine whether the engine should remain in sleep mode.

8. The apparatus of claim 5 wherein the external source is an engine control unit of at least one other vehicle.

9. The apparatus of claim 5 wherein the external source is a vehicle operator.

10. The apparatus of claim 1 wherein the at least one engine parameter monitored is engine temperature.

11. The apparatus of claim 1 wherein the at least one engine parameter monitored is battery charge level.

12. The apparatus of claim 1 wherein the engine control unit is further capable of intelligent machine learning.

13. The apparatus of claim 1 wherein if the engine should not remain in sleep mode, the engine control unit shuts down the engine.

14. The apparatus of claim 1 wherein if the engine should not remain in intelligent sleep mode, the engine control unit sends a signal that the engine should be taken out of sleep mode.

15. A method of enhancing operating efficiency in an internal combustion engine comprising the steps of:

a) using at least one sensor to monitor at least one engine parameter;

b) using an engine control unit to collect data from the at least one sensor;

c) inputting the data collected from the at least one sensor into at least a first computerized algorithm to determine whether to place the engine in sleep mode;

d) having the engine control unit place the engine in sleep mode;

e) using the at least one sensor to monitor engine parameters after the engine has been placed in sleep mode; and f) using at least a second computerized algorithm to analyze the data collected in step e to determine if the engine should remain in sleep mode.

16. The method of claim 15 further comprising the engine control unit communicating with an engine control unit of at least one other vehicle, wherein at least the first computerized algorithm uses the information received from the engine control unit of the at least one other vehicle to determine whether the engine of the first vehicle should be placed in sleep mode.

17. The method of claim 15 further comprising the engine control unit communicating with at least one remote system to obtain information about the engine, wherein at least the first computerized algorithm uses the information received from the at least one remote system to determine whether the engine should be placed in sleep mode.

18. The method of claim 15 wherein in step d the engine control unit signals an operator of the engine to place the engine in sleep mode.

19. The method of claim 15 further comprising the engine control unit communicating with an engine control unit of at least one other vehicle, the engine control unit capable of using the information received from the engine control unit of the at least one other vehicle in at least the second computerized algorithm to determine whether the engine should remain in sleep mode.

20. The method of claim 15 in which placing the engine in sleep mode comprises turning off the engine pistons.

21. The method of claim 15 in which placing the engine in sleep mode comprises placing the engine at a low idle, and turning off one or more auxiliary systems.

22. The method of claim 15 wherein the at least one algorithm considers such factors as fuel costs, engine wear, engine run time, number of starts when determining whether the engine should be placed in sleep mode.

23. The method of claim 15 further comprising the engine control unit restarting the engine if it is not to remain in sleep mode.

24. The method of claim 15 further comprising the engine control unit sending a signal to a machine operator if the engine is not to remain in sleep mode.

* * * * *